US006598550B1

(12) United States Patent
Patel

(10) Patent No.: US 6,598,550 B1
(45) Date of Patent: Jul. 29, 2003

(54) EMERGENCY BUOYANCY SYSTEM FOR A VESSEL

(76) Inventor: Neal Patel, 1901 Candlelight Ct., Friendswood, TX (US) 77546

( * ) Notice: Subject to any disclaimer, the term of this patent is extended or adjusted under 35 U.S.C. 154(b) by 0 days.

(21) Appl. No.: 10/020,613

(22) Filed: Dec. 14, 2001

(51) Int. Cl.[7] ..... B63C 7/00
(52) U.S. Cl. ..... 114/54; 114/360
(58) Field of Search ..... 114/360, 54, 68, 114/69

(56) References Cited

U.S. PATENT DOCUMENTS 686,412 A * 11/1901 Magnin ..... 441/101
1,375,055 A * 4/1921 Lodato ..... 114/68
4,867,094 A * 9/1989 Binks ..... 114/359
4,887,541 A 12/1989 Rodemann
4,996,936 A * 3/1991 Brundritt ..... 114/123
6,080,027 A 6/2000 Rodemann

FOREIGN PATENT DOCUMENTS

FR 2667567 A1 * 4/1992 ..... B63C/7/10

* cited by examiner

*Primary Examiner*—Jesus D. Sotelo
(74) *Attorney, Agent, or Firm*—Browning Bushman P.C.

(57) ABSTRACT

An emergency buoyancy system mounted to a vessel includes a depth sensor to sense a predetermined maximum depth, and an actuator actuated by the depth sensor. The actuator, upon actuation, opens a membrane between tanks, each holding one of a pair of gas producing chemicals. The gas producing chemicals, preferably bicarbonate of soda and vinegar, mix together to produce carbon dioxide. The carbon dioxide fills a plurality of balloons, thereby providing buoyancy to the vessel to which the balloons are attached.

12 Claims, 2 Drawing Sheets

12
20
20
20
22
22
22
10

12
26
60
62
22
60
24
20
62
24
26
22
24
62
10
60

EMERGENCY BUOYANCY SYSTEM FOR A VESSEL

FIELD OF THE INVENTION

The present invention relates generally to the field of emergency buoyancy systems for vessels and, more particularly, to an automatically deployed buoyancy system which senses hydrostatic pressure and, upon sensing a predetermined threshold of pressure, mixes two chemicals which form a gas, thereby filling buoyancy balloons or bladders to maintain the vessel afloat.

BACKGROUND OF THE INVENTION

Every year, vessels are lost at sea. Pleasure vessels, both power and sail, are also all too commonly lost on rivers and lakes throughout the world. In small craft, the problem has been somewhat alleviated by the advent of new materials of construction, whereby the vessel itself is made of a flotation material, so that if the entire vessel is filled with water, then the craft does not sink. The problem remains, however, with larger vessels.

Many systems have been designed and installed to make ships and boats more seaworthy and to keep such craft afloat if they begin to take on water. Most commonly, ships use pumps of one sort or another to pump water from inside the hull to a discharge over the side. Such systems have been used successfully for generations, and have save many lives, so long as the capacity of the pumping system exceeds the rate at which water is entering the hull through a breach. Once the rate at which water is taken on outstrips the capacity of the pumps to pump it over, the vessel is doomed to sink.

Thus, there remains a need for a system to keep vessels afloat, even if emergency bilge pumps and the like cannot keep up with the rate at which water is taken on in a flooding situation. Such a system should provide buoyancy to the vessel by displacing sufficient water to keep the vessel afloat, either until help can arrive, repairs can be performed, or until the vessel can be brought to port.

Pure distilled water has a relative weight of 1 at a temperature of 4° C., that is, 1 $cm^3$ of water weighs 1 gram. Seawater is heavier than fresh water by 2.5–3% because of the greater amount of salts dissolved in it; its relative weight is 1.025. It may be concluded that a vessel weighs less in seawater than in fresh water. Relative weight is important for determining buoyancy. Thus, if sufficient volume of fresh water is displaced by a buoyancy system to maintain a vessel afloat, the system will also maintain the same vessel afloat in seawater. The present invention is directed to solving this long felt problem in the art.

SUMMARY OF THE INVENTION

The present invention provides an emergency buoyancy system mounted to a vessel that includes a depth sensor to sense a predetermined maximum depth, and an actuator actuated by the depth sensor. The actuator, upon actuation, opens a membrane between a pair of gas producing chemicals. The gas producing chemicals, preferably bicarbonate of soda and vinegar, mix together to produce carbon dioxide. The carbon dioxide fills a plurality of balloons, thereby providing buoyancy to the vessel to which the balloons are attached.

The buoyancy system preferably includes a large number of relatively small balloons anchored to the frames of the vessel. That way, if any balloon fails to inflate, or is damaged in some way so that it does not contribute to the buoyancy of the vessel, the remaining balloons will still float the vessel, and very little instability is introduced by the failure of one or even a small number of balloons.

The balloons are preferably anchored to the frames of the vessel, and no to the hull or any other portion of the ship which is not designed to withstand the upward force contributed by the balloons. The balloons are each relatively small, no more than a hundred cubic meters or so, but a large number is provided to provide more than enough buoyancy to float the vessel even if it is substantially damaged. In fact, the vessel can the separated into several sections and since the balloons are dispersed along the hull, each fragment of the vessel is floated by the present invention.

For example, a 10,000 ton ship weighs about 20 million pounds, or 9 million kilograms. The balloons of the present invention must displace about 9,000 cubic meters of water to provide the entire buoyancy to the ship, although that is the worst case scenario. If each small balloon displaces 100 cubic meters when fully inflated, then about 90 such balloons, or 45 on the starboard side and 45 on the port side are required. Each balloon will therefore be roughly 6 meters in diameter. To provide adequate margin for buoyancy, including some system failures, the present invention contemplates at least 100 such balloons on each side of a vessel of this size. Smaller vessel require smaller and fewer balloons. And, since the balloons are dispersed in an array along the hull of the ship, if the ship breaks up then each piece of the ship will have an adequate portion of the floatation system of this invention.

While the bicarbonate of soda and vinegar are preferred, other gas producing chemicals may be used. In any event, one of the gas producing chemicals is preferably a liquid, since the preferred embodiment relies on gravity to bring the liquid chemical into contact with the other gas producing chemical.

These and other features of the invention will be apparent to those of skill in the art from a review of the following detailed description along with the accompanying drawings.

DETAILED DESCRIPTION OF A PREFERRED EMBODIMENT

Figure 1:
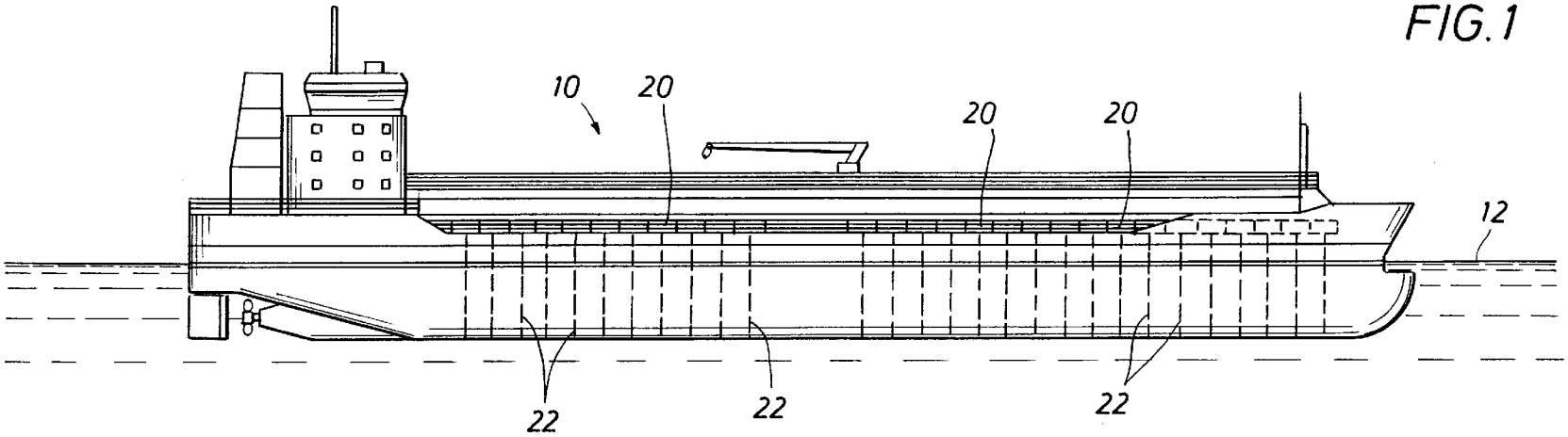
FIG. 1 is a side elevation view of a representative vessel on which the present invention has been installed.

FIG. 1 depicts a vessel 10 afloat in water 12 and underway. Mounted along the side of the vessel 10 are canisters 20, each of which houses a relatively small floatation system which operates independently of the floatation system in any other of the canisters 20. As shown in FIG. 1, the canisters 20 are arrayed along the side of the hull, and preferably more than one row of canisters is included, but not shown in FIG. 1 for clarity of illustration. Each of the canisters is burstable to release a balloon or bladder, once inflated, that is stored in the canister.

Figure 2:
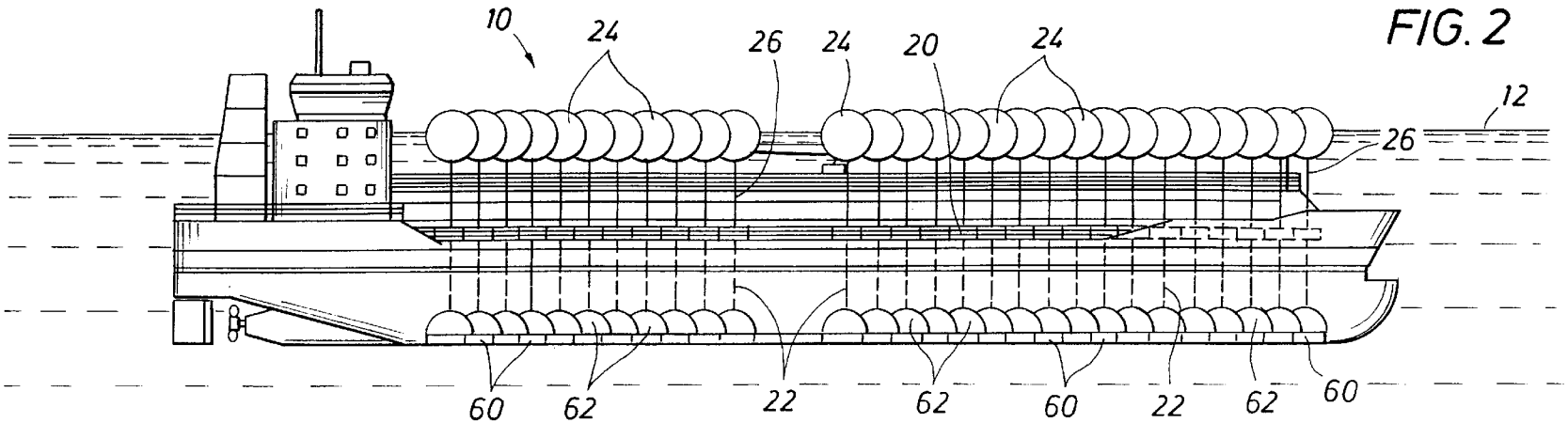
FIG. 2 is a side elevation view of the vessel with the present invention deployed.

Each canister 20 is preferably mounted to a frame 22 of the vessel. Frames of a vessel typically run in vertical, spaced apart locations to provide rigidity to the hull, and the present invention, by mounting to the frames, takes advantage of the structural strength of the frames to provide lift to the vessel when deployed. In FIGS. 1 and 2, only some of the canisters are shown, but preferably the canisters are mounted the entire length of the vessel for the greatest dispersal of the lifting force of the buoyancy system.

FIG. 2 conceptually depicts the buoyancy system when the system is deployed. As shown in FIG. 2, each canister deploys one or more balloons 24 from the canister, spread along the length of the vessel for evenly spread lifting force. By spreading out the lifting force, less stress is induced into the hull structure by the floatation system. Each of the balloons is anchored to a frame 22 of the ship by a lanyard or chain 26 and the length of the lanyard can be varied from one canister to the next in order to provide less interference between balloons.

Also as shown in FIG. 2, the buoyancy system may alternatively or additionally include a plurality of canisters 60 each of which deploys one or more balloons 62. This feature of the invention provides the advantage of being able to lift the vessel sufficiently to provide freeboard, or clearance of the gunwale above the water level 12. The canisters 60 are preferably secured to the vessel well below the center of gravity of the vessel, but symmetrically spaced on either side of the keel or centerline of the vessel. The balloons 62 are also deployed along the bottom of the vessel, and distributed fore and aft so as to minimize the stress induced by the buoyancy system of the structure of the vessel.

Figure 3:
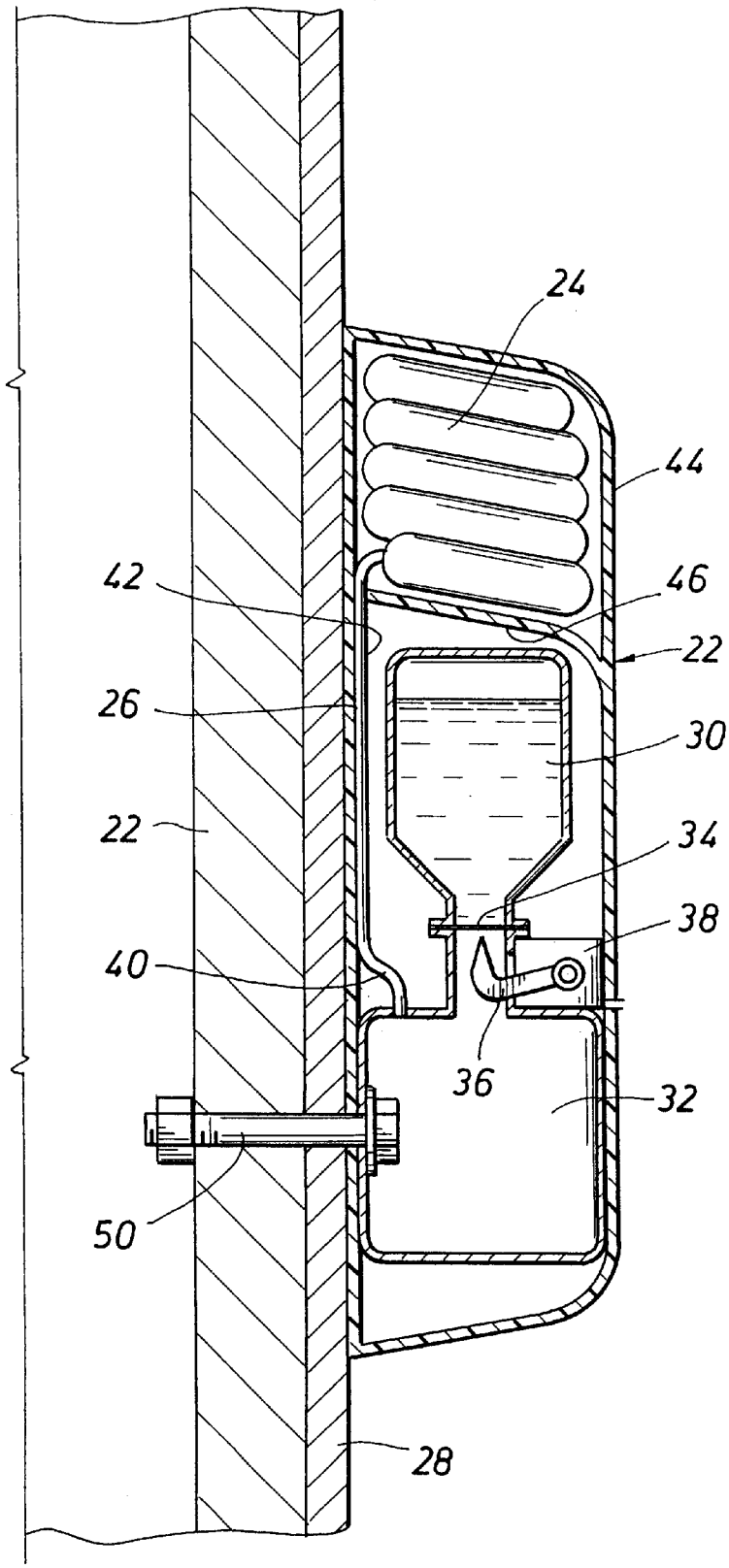
FIG. 3 is a section view from the side of one canister of this invention, illustrating the components of the floatation system and its mounting to a vessel hull.

FIG. 3 depicts a side section view of a canister 20. As previously described, the canister 20 is mounted to a frame 22 of the vessel. A hull plate 28 mounts to the frame 22 in the conventional manner.

The canister 20 encloses a liquid tank 30, preferably retaining a quantity of one of the gas producing chemicals, such as for example vinegar. The liquid tank 30 is preferably made from a durable plastic which resists the corrosive effects of the chemical within it. Mounted beneath the liquid tank 30 is a tank 32 for retaining the other gas producing chemical, such as for example bicarbonate of soda. In between the tank 30 and the tank 32 is a thin membrane 34, sufficiently strong to separate the liquid in the tank 30 from the chemicals in the tank 32 until punctured by a probe 36. The probe 36 is released by a pressure sensor 38, which senses hydrostatic pressure of water on the outside of the canister. Preferably, the pressure sensor 38 is set to release the probe 36 at about 0.5 atmosphere, providing sufficient tolerance to prevent the inadvertent release of liquid chemical from the tank 30, and yet low enough to provide buoyancy to the vessel before the vessel is submerged in the event of a sinking emergency.

When liquid chemicals are released from the tank 30 into the tank 32, a chemical reaction is set up, whereby carbon dioxide is generated in the tank 32. The carbon dioxide is release from the tank 32 to an outlet port 40. The outlet port 40 feeds carbon dioxide to a reinforced tube 42, which may also function as the lanyard 26, although preferably the tube 42 is simply supported alongside the lanyard to save on construction costs. The tube 42 feeds into the bottom of a balloon 24, which is stored in a compartment 44 which is contiguous to the chamber holding the tanks 30 and 32, but separated from it by a bulkhead 46. This is because the compartment must remain intact until the balloon 24 begins to inflate, but then the compartment 44 must then burst open to release the balloon so that it may be deployed.

It should be noted that the lanyard is secured to the balloon 24, and that it is also secured to the frame 22 as with a bolt 50 or the like. Preferably, the bolt 50 also secures the canister 20 to the frame. Preferably, the bolt 50 is made of a hard durable plastic to avoid corrosion of the hull and frame at the spot where the bolt penetrates the hull.

The principles, preferred embodiment, and mode of operation of the present invention have been described in the foregoing specification. This invention is not to be construed as limited to the particular forms disclosed, since these are regarded as illustrative rather than restrictive. Moreover, variations and changes maybe made by those skilled in the art without departing from the spirit of the invention.

I claim:

1. An emergency buoyancy system for a vessel comprising a plurality of canisters mounted to the port side of the vessel and a plurality of canisters mounted to the starboard side of the vessel, each canister comprising:

a. a first tank adapted to retain a first chemical;

b. a second tank adapted to retain a second chemical, wherein the first and second chemicals produce a gas when they come in contact with one another;

c. a membrane between the first and second tanks;

d. a pressure sensor adapted to sense hydrostatic pressure in the vicinity of the canister;

e. a probe, actuated by the pressure sensor, upon sensing by the pressure sensor of a predetermined pressure, the probe positioned to pierce the membrane upon actuation by the pressure sensor, thereby releasing the first chemical into the second tank to contact the second chemical; and f. a balloon in fluid communication with the second tank to receive gas from the second tank to inflate the balloon, thereby providing buoyancy to the vessel.

2. The system of claim 1, further comprising a lanyard mounting the balloon to the vessel.

3. The system of claim 2, wherein the vessel includes a plurality of frames, and wherein the lanyard is mounted to one of the plurality of frames.

4. The system of claim 2, wherein the lanyard is mounted to the vessel with a bolt, and wherein the cannister is mounted to the vessel with the bolt.

5. The system of claim 2, wherein the lanyard may vary in length from one canister to another.

6. The system of claim 1, wherein the balloon is positioned within a burstable chamber within the canister.

7. The system of claim 1, wherein the first chemical is vinegar and the second chemical is bicarbonate of soda.

8. The system of claim 1, wherein the canister is formed of plastic.

9. The system of claim 1, wherein at least some of the plurality of canisters are mounted below the center of gravity of the vessel.

10. The system of claim 1, wherein at least some of the plurality of canisters are mounted alongside the keel of the vessel.

11. A method of providing emergency buoyancy to a vessel comprising the steps of:

a. storing at least two chemicals which, when mixed, produce a gas, the stored chemicals maintained separated from each other until mixed;

b. storing a collapsed balloon in fluid communication with chamber wherein gas will be produced by the mixing of the stored chemicals;

c. sensing hydrostatic pressure at a point on the vessel and, when a predetermined hydrostatic pressure is sensed, d. mixing the chemicals to produce a gas; and e. directing the gas into the balloon, thereby inflating the balloon to provide emergency buoyancy to the vessel.

12. The method of claim 11, wherein the chemicals comprise vinegar and bicarbonate of soda.

* * * * *